US012474050B2

(12) United States Patent
Frigiere

(10) Patent No.: US 12,474,050 B2
(45) Date of Patent: Nov. 18, 2025

(54) LIGHTER COMPRISING A CONTAINER SUITABLE FOR LIQUEFIED GAS AND A COMPRESSIBLE MEMBER TO PREVENT OVERFILLING OF THE CONTAINER

(71) Applicant: SOCIÉTÉ BIC, Clichy (FR)

(72) Inventor: Rene Frigiere, Clichy (FR)

(73) Assignee: SOCIÉTÉ BIC, Clichy (FR)

( * ) Notice: Subject to any disclaimer, the term of this patent is extended or adjusted under 35 U.S.C. 154(b) by 430 days.

(21) Appl. No.: 18/000,084

(22) PCT Filed: May 25, 2021

(86) PCT No.: PCT/EP2021/063885
§ 371 (c)(1),
(2) Date: Nov. 28, 2022

(87) PCT Pub. No.: WO2021/239725
PCT Pub. Date: Dec. 2, 2021

(65) Prior Publication Data

US 2023/0213190 A1 Jul. 6, 2023

(30) Foreign Application Priority Data

May 29, 2020 (EP) ..... 20315283

(51) Int. Cl.
*F23Q 2/42* (2006.01)
*F23Q 2/173* (2006.01)

(52) U.S. Cl.
CPC ..... *F23Q 2/42* (2013.01); *F23Q 2/173* (2013.01)

(58) Field of Classification Search
CPC ..... F23Q 2/42; F23Q 2/16; F23Q 2/173
See application file for complete search history.

(56) References Cited

U.S. PATENT DOCUMENTS

| | | | |
|---|---|---|---|
| 3,406,000 A | 10/1968 | Wright | |
| 3,813,041 A | 5/1974 | Kleine | |
| 5,716,204 A | 2/1998 | Mifune et al. | |

FOREIGN PATENT DOCUMENTS

| | | | | |
|---|---|---|---|---|
| DE | 10009361 A1 | | 9/2001 | |
| EP | 2305051 A1 | * | 4/2011 | ..... A24F 47/006 |
| FR | 1427208 A | | 2/1966 | |
| FR | 2665242 A1 | | 1/1992 | |
| JP | S5282567 U | | 6/1977 | |
| JP | S5674524 A | | 6/1981 | |
| JP | S5677626 A | | 6/1981 | |
| JP | 2217715 A | | 8/1990 | |

OTHER PUBLICATIONS

International Search Report issued in International Application No. PCT/EP2021/063885 on Oct. 5, 2021 (13 pages).

* cited by examiner

*Primary Examiner* — Alfred Basichas
(74) *Attorney, Agent, or Firm* — Bookoff McAndrews, PLLC

(57) ABSTRACT

A lighter comprising a container suitable for containing a liquified gas or a mixture of a liquid and a gas, characterized by a compressible member which is arranged in the container.

20 Claims, 2 Drawing Sheets

LIGHTER COMPRISING A CONTAINER SUITABLE FOR LIQUEFIED GAS AND A COMPRESSIBLE MEMBER TO PREVENT OVERFILLING OF THE CONTAINER

CROSS REFERENCE TO RELATED APPLICATIONS

This application is a National Stage Application of International Application No. PCT/EP2021/063885, filed on May 25, 2021, now published as WO2021239725 and which claims priority from European Application No. 20315283.0, filed on May 29, 2020, the entire contents of which is incorporated herein by reference.

TECHNICAL FIELD

The present disclosure concerns the field of lighter systems, in particular lighters for usage with liquefied gas or a mixture of liquid and gas.

TECHNICAL BACKGROUND

Portable combustion products, such as lighters, are commonly designed having a container to store a flammable material, that will be ignited to produce a flame. The flammable material is generally a liquefied petroleum gas (LPG), that is filled under pressure in the container of the lighter through a filling valve of the lighter. During release of the LPG from the container through a release device, in particular an exit valve arranged in the lighter, the gas expands and is mixed with the direct surrounding air. The mixture of gas with the oxygen contained in the surrounding air is ignited at the exit valve of the lighter to produce a flame.

The object of the present disclosure is to provide a lighter and a container for containing liquefied gas or a mixture of a liquid and gas with improved safety.

SUMMARY

The present disclosure relates to a lighter as defined in claims 1 and 12. The dependent claims depict advantageous embodiments of the present disclosure.

According to the present disclosure, a container, especially for a lighter and preferably arranged in the lighter, suitable for containing a liquefied gas or a mixture of a liquid and a gas comprises a compressible member which is arranged in the container or a dividing element dividing the container volume into a first volume containing the liquefied gas or the mixture of liquid and gas and into a second separate volume. The compressible member and the dividing element are impermeable to gases and liquids.

In this document, a lighter can be defined as being a portable combustion product and/or a flame producing assembly. Such products and/or assemblies are generally designed to produce a flame out of the combustion of a flammable material, when ignited by an ignition device, that can be integrated to the lighter. The flammable material can be stored within the portable combustion product and/or flame producing assembly, for example in a container comprised within or at the housing of the lighter. The flammable material used in lighters can be liquefied gas, for example liquefied hydrocarbon of the n-butane, isobutane, propane type or a mixture of these gases commonly named liquefied petroleum gas (LPG). The portable combustion products and/or flame producing assemblies are widely used for igniting a variety of combustible materials and items such as cigarettes, candles, flammable gas (e.g., in gas stoves), fireplaces, and many others. Portable combustion products and/or flame producing assemblies can be commercially available in different forms and sizes.

Liquefied gas or a mixture of a liquid and a gas, in particular LPG, has the property to transform gas at least partially into liquid at certain pressure, which allows the gas to be stored in large quantities in a container, mainly in liquid phase, but also partially in gaseous phase (or gaseous sky), both in thermodynamic equilibrium. In filled condition, a typical pressure within the container at 23° C. is 250 kPa (above the ambient pressure surrounding the container). The liquid fraction of the liquefied gas can expand with temperature increase, this in proportions directly related to the cubic expansion coefficient of the liquefied gas. A risk situation can occur if an increase of the ambient temperature results in an increased pressure within the container (compared to the ambient pressure surrounding the container) associated without sufficient expansion space within the container. An increased pressure results in the risk that the container gets over pressurized and thus, may burst with possible rapid combustion of the gas into a fireball ("boiling liquid expanding vapor explosion"). This risk is particularly problematic in case of lighters having a refillable container. If the user overfills the container with liquefied gas, the volume for the gaseous phase is very small such that an increased temperature results in a higher internal pressure compared to the situation in which the container is initially filled with less liquefied gas. Non-refillable containers may also be subjected to this risk, but the problem is solved by the producer itself by controlling the filling level during factory filling.

With the present disclosure, risk of overfilling of the container with liquefied gas or a mixture of liquid and gas can be avoided or reduced, because part of the container volume is occupied by a compressible member. If the ambient temperature increases after initial filling of the container, the pressure in the container also increases. At the same time, the compressible member is compressed due to the increased pressure, providing an increased volume occupied by the liquefied gas. Accordingly, the pressure within the container is lower at an increased ambient temperature compared to a container having no compressible member. Therefore, the risk that the container may burst is reduced with the present disclosure.

According to further optional aspects of the disclosure, such a lighter may incorporate one or several of the following features:

In addition or alternatively, the volume containing the liquefied gas may be a first volume and the volume delimited by the outer shape of the compressible member may be a second separate volume. Preferably, both the second volume occupied by the compressible member may be gas- and fluid-tight with respect to the first volume.

In addition or alternatively, the total volume of the container constituted by the first and the second volume may be constant at a given ambient pressure (in particular at 1 atm) and a given ambient temperature (in particular at 23° C.).

In addition or alternatively, the second volume may be reduced by expanding the first volume.

In addition or alternatively, the compression state of the compressible member may depend on the amount of the liquefied gas or the mixture of liquid and gas contained in the first volume.

The division of the total container volume in two separate and variable volumes may allow the first volume to increase and the second volume to decrease as a consequence of thermal expansion of the liquefied gas, and vice versa if the liquefied gas is cooled down. In particular, the compressible member may compensate the expansion of the first volume within the container. One advantage of such a compressible member is that it can at least partially absorb the pressure that would have been applied by the liquefied gas on the inner walls of the container.

According to a further optional aspect of the disclosure, the compressible member may be compressed from an uncompressed state in which the pressure in the container is identical to the ambient pressure, to a first compressed state when the container is filled with a pre-set maximum amount of liquefied gas or of the mixture of liquid and gas.

At ambient temperature and ambient pressure, the compressible member may be in a relaxed, uncompressed state. When liquefied gas is filled in the container, the compressible member may be subjected to the vapour pressure of the gas, which may result in a first compression state of the member. The maximum amount of liquefied gas that can be filled in the container may be limited by the compressible member at a certain filling pressure to avoid a possible burst of the lighter due to an increased temperature after the filling of the lighter/container.

At constant temperature, the first and the second volumes may be constant, and the compressible member may only be compressed to an extend according to the pressure exerted by the first volume on the second volume. For this purpose, the compressible member may be dimensioned taking into consideration the characteristics of the filling process, especially the temperature at filling, and of the liquefied gas used. Once the first compressed state of the member is reached, further filling of the first volume may no longer be possible without temperature change.

In addition or alternatively, the first compressed state of the compressible member may be achieved when the container is filled with an amount of liquefied gas or of the mixture of liquid and gas at a pressure of 250 kPa above the ambient pressure.

In addition or alternatively, the compressible member could be further compressed from the first compressed state to at least a second compressed state when the pressure in the container is increased by an expansion of the liquefied gas or the mixture of liquid and gas caused in particular by an increased temperature, in particular 60° or 90° C., compared to the temperature, in particular 23° C., which was present during the initial filling of the container with the pre-set maximum amount of liquefied gas or of the mixture of liquid and gas.

In some usage or storage conditions, the temperature of the lighter may increase, which may result in a partial evaporation of the liquid phase into the gaseous phase, accompanied by a pressure increase within the first volume. Consequently, the second volume may be further compressed.

The lighter of the present disclosure may further incorporate following optional aspects.

In addition or alternatively, the compressible member may occupy at least 10% of the total volume of the container when the pressure in the container is identical to the ambient pressure surrounding the lighter, in particular at least 20%, more particular at least 30%.

In addition or alternatively, the compressible member may occupy not more than 20% of the total volume of the container when the pressure in the container is 250 kPa higher than the ambient pressure surrounding the lighter, in particular not more than 15%, more particular not more than 10%.

In addition or alternatively, the compressible member may occupy not more than 10% of the total volume of the container when the pressure in the container is 1700 kPa higher than the ambient pressure surrounding the lighter, in particular not more than 8%, more particular not more than 5%.

In addition or alternatively, the compressible member may be made of a polymer, in particular polyurethane or butadiene-acrylonitrile copolymer.

In addition or alternatively, the material of the compressible member may be porous and may comprise closed cells.

The features described are not limited to the first aspect of the disclosure but may apply, where applicable, to any other aspect of the disclosure.

According to another aspect of the present disclosure, a dividing element dividing the container volume into a first volume containing the liquefied gas or the mixture of liquid and gas and into a second separate volume, in a gas- and fluid-tight manner, may be used instead of or in addition to a compressible member. If the pressure within the first volume increases (in particular due to an increased ambient temperature), the dividing element may move or change its shape in order to increase the first volume and to decrease the second volume at the same time.

According to further optional aspects of the disclosure, such a lighter may incorporate one or several of the following features.

In addition or alternatively, the dividing element may be a membrane or a flexible element.

In addition or alternatively, the total container volume comprising the first volume and the second volume may be constant at a given ambient pressure and a given ambient temperature.

In addition or alternatively, the second separate volume could be reduced by expanding the first volume.

In addition or alternatively, the compression state of the second separate volume may depend on the amount of the liquefied gas or the mixture of liquid and gas contained in the first volume.

In addition or alternatively, the second separate volume may be compressed from an uncompressed state in which the pressure in the container is identical to the ambient pressure, to a first compressed state when the container is filled with a pre-set maximum amount of liquefied gas or of the mixture of liquid and gas.

In addition or alternatively, the first compressed state of the second separate volume may be achieved when the container is filled with an amount of liquefied gas or of the mixture of liquid and gas at a pressure of 250 kPa above the ambient pressure.

In addition or alternatively, the second separate volume could be further compressed from the first compressed state to at least a second compressed state when the pressure in the container is increased by an expansion of the liquefied gas or the mixture of liquid and gas caused in particular by an increased temperature, in particular 60° or 90° C., compared to the temperature, in particular 23° C., which was present during the initial filling of the container with the pre-set maximum amount of liquefied gas or of the mixture of liquid and gas.

In addition or alternatively, the second separate volume may occupy at least 10% of the total volume of the container when the pressure in the container is identical to the ambient pressure surrounding the lighter, in particular at least 20%, more particular at least 30%.

In addition or alternatively, the second separate volume may occupy not more than 20% of the total volume of the container when the pressure in the container is 250 kPa higher than the ambient pressure surrounding the lighter, in particular not more than 15%, more particular not more than 10%.

In addition or alternatively, the second separate volume may occupy not more than 10% of the total volume of the container when the pressure in the container is 1700 kPa higher than the ambient pressure surrounding the lighter, in particular not more than 8%, more particular not more than 5%.

Although any of the previous embodiments may be used in relation with any standard lighter system, some optional features of a liquefied gas and lighter may be outlined.

In addition or alternatively, the liquefied gas of the mixture of liquid and gas may have a vapour pressure at 23° C. that is equal or greater than 104 kPa.

In addition or alternatively, the total container volume may be in the range of 2 to 200 cm3, in particular in the range of 3 to 100 cm3, more particular in the range of 3 to 20 cm3.

In addition or alternatively, the container could be refilled with liquefied gas or a mixture of liquid and gas.

In addition or alternatively, the lighter may comprise a first valve device for refilling the container.

In addition or alternatively, the lighter further may comprise a second valve device for withdrawing gas from the container.

In addition or alternatively, the lighter further may comprise an igniting device for igniting the gas exiting the container through the second valve.

According to another aspect of the disclosure, the container is suitable for containing a liquefied gas or a mixture of a liquid and a gas, wherein a compressible member is arranged in the container or wherein a dividing element divides the container volume into a first volume containing the liquefied gas or the mixture of liquid and gas and into a second separate volume.

The liquefied gas which may be used for the present disclosure can be for example liquefied hydrocarbon of the n-butane, isobutane, propane type or a mixture of these gases commonly named liquefied petroleum gas (LPG).

BRIEF DESCRIPTION OF THE DRAWINGS

Additional details and features of the disclosure are described in reference to the following figures in which.

DETAILED DESCRIPTION

Embodiments of the lighters and containers according to the disclosure will be described in reference to the figures as follows.

Figure 1A:
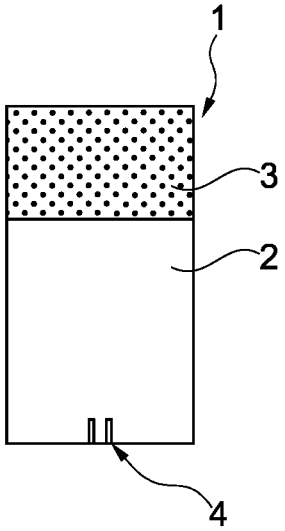
FIGS. 1*a* to 1*c* are schematic views of a container of a lighter according to a first aspect of the disclosure, in empty state (1*a*), filled state (1*b*) and pressurized state (1*c*)
Figure 1B:
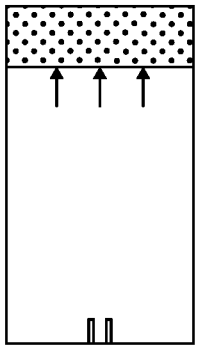
Figure 1C:
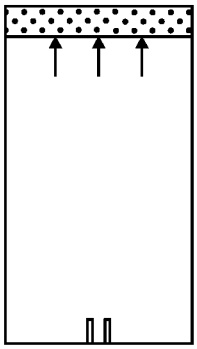

FIG. 1*a* to 1*c* present a container 1 of a lighter according to a first aspect of the disclosure. The container 1 comprises a variable first volume 2 that can receive a liquefied gas, and a compressible member, that occupies and defines a variable second volume 3. First volume 2 and second volume 3 constitute a total and constant volume of the container 1. The compressible member is porous and consists of several closed and deformable/compressible cells. It can be made of a polymer, in particular polyurethane or butadiene-acrylonitrile copolymer. An important property of the member is its compressibility.

In FIG. 1*a*, the first volume 2 does not contain liquefied gas and the compressible member is only subjected to the ambient temperature and ambient pressure. In this configuration, the compressible member occupies an initial volume $v_i$ which represents at least 10% (or at least 20%, or at least 30%), most preferably 15% of the total volume $V^0$ of the container 1. The compressible member is in an uncompressed state.

In FIG. 1*b*, liquefied gas has been filled in the first volume 2 through the filling valve 4. The pressure in the first volume 2 typically corresponds to the pressure used for filling the liquefied gas. This pressure also compresses the compressible member. The liquid phase and gaseous phase (also called "gaseous sky") are contained within the first volume 2. Both phases are present in the container in a thermodynamic equilibrium. In normal operation and at room temperature, when gas is withdrawn from the container, the liquid boils and the resulting vapour compensates the volume withdrawn to rebuild the equilibrium. At 23° C. filling temperature (equal to ambient temperature), the vapour pressure of the gaseous phase in the container 1 can be greater than 104 kPa. Due to the pressure of the first volume 2 on the second volume 3 (depicted with the arrows from the first volume to the second volume on FIG. 1*b*), the compressible member is compressed to a volume $v_0$.

The size and material characteristics of the compressible member may be chosen in a way that, the compressible member occupies not less than 15% (in some other examples not more than 10%) of the total volume of the container 1 at 23° C. ($v_0/V_0$=15%) at a certain filling pressure, e.g. at 250 KPa (above the ambient pressure). As consequence, the filling volume of the first volume 2 does not exceed 85% under these conditions. Therefore, the compressible member limits the maximum amount of liquefied gas within the container during filling, wherein the first volume 2 can further expand after filing due to an increased temperature by further compressing the compressible member.

Any increase of temperature in the environment, for example to 60° C. or 90° C., leads to a temperature increase of the liquefied gas in the container 1, resulting in a pressure increase of the gaseous phase of the liquefied gas. In the case where the liquid occupies exactly the entire free volume of the reservoir, the compressible element will compress by a value proportional to the increase in volume of the liquid according to its coefficient of cubic expansion. Therefore, the pressure exerted on the compressible member also increases and can for example reach 1700 kPa above the ambient pressure or more, which leads the second volume 3 of the compressible member to reduce even more (FIG. 1*c*). In this configuration, the compressible member occupies not more than 10% of the total volume of the container 1, or not more than 8%, or not more than 5%.

In the practical case of a lighter with an internal volume Vo=10 cm3 filled with isobutane and where the liquid occupies exactly the entire free volume of the container, the rate of crushing $v_i/v_f$ would be 7 at 1700 kPa and 90° C.

The compression property of the member permits to balance the pressure increase between the first volume 2 and the second volume 3 at constant total volume of the container 1 instead of having the container 1 itself expand and possibly even burst. For portable products such as torches, lighters or utility lighters, the liquefied gas used can be for example liquefied hydrocarbon of the n-butane, isobutane, propane type or a mixture of these gases commonly named liquefied petroleum gas (LPG).

One risk using LPG is that if the initial liquid level is too high (above 85% of the volume fraction at 23° C.), thermal expansion can cause the gas phase to disappear (the container is then in "full hydraulic state"), and the internal pressure can increase very quickly at the slightest increase in environment temperature. This can cause the container to burst as a result of excessive pressurization of the inner walls of the container. An explosion, also called a "boiling liquid expanding vapor explosion" (BLEVE) could even occur in the worst case. This situation is caused by the complete destruction of the pressurized container containing a liquid, whose temperature is much higher than its boiling point at atmospheric pressure with dramatic consequences following the expansion of the gas sky, the sudden vaporization of the liquid, the possible rapid combustion into a fireball and the dispersion of the container fragments.

Figure 2:
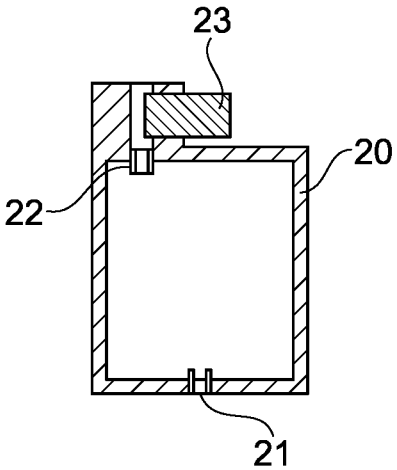
FIG. 2 is a schematic view of a lighter.

FIG. 2 shows a standard lighter, comprising a container 20 with a first valve device 21 for refilling the container 20, a second valve device 22 for withdrawing the gas from the container, and an igniting device 23 for igniting the gas exiting the container through the second valve 22.

Figure 3A:
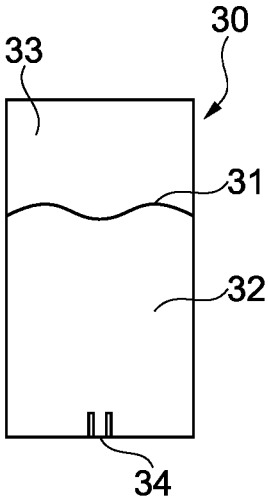
FIGS. 3*a* to 3*c* are schematic views of a container of a lighter according to a second aspect of the disclosure, in empty state (3*a*), filled state (3*b*) and pressurized state (3*c*)
Figure 3B:
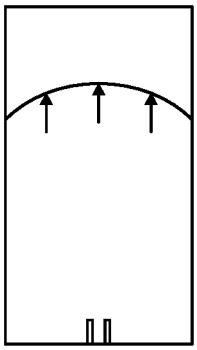
Figure 3C:
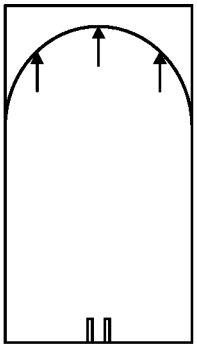

FIG. 3*a* to 3*c* present a container 30 according to a second aspect of the disclosure. Here, the total container volume is divided by a dividing element 31 such as a membrane or a flexible element into a variable first volume 32 and a variable second volume 33. The first volume 32 is configured to be filled with the liquefied gas and the second volume 33 is filled with air, and the dividing element 31 has the function to balance the pressure differences between the first volume 32 and the second volume 33. The addition of the first volume 32 and the second volume 33 is always constant and represents the total volume of the container 30. To not mix the content of the first volume 32 with the content of the second volume 33, the dividing element 31 is fixed to the inner surface of the container 30 and defines a gas and fluid tight separation. The location of the attachment point of the dividing element 31 to the inner surface of the container 30 is determined in combination with the material characteristics of the dividing element 31 such as to obtain an optimum volume repartition between the first volume 32 and the second volume 33, especially once the liquefied gas is filled within the first volume 32.

In FIG. 3*a*, the first volume 32 is empty from liquefied gas and the dividing element 31 is only subjected to the ambient temperature and ambient pressure. At this state, the second volume 33 may occupy at least 10% of the total volume of the container 30, or at least 20%, or at least 30%.

In FIG. 3*b*, liquefied gas is filled in the first volume 32 through a filling valve 34. The liquefied gas exerts a pressure on the dividing element 31 of, for example, 250 kPa higher than the ambient pressure at 23° C., which leads the dividing element 31 to bend in direction of the second volume 33. Pressure is thus applied on both sides of the dividing element 31, which brings it to an equilibrium position within the container 30. Ideally, at this state, the second volume 33 occupies approximately 15% of the total volume of the container 30 to assure enough volume for the liquefied gas to expand. Alternatively, the second volume can occupy not more than 20% of the total volume of the container 30, or not more than 15%, or not more than 10%.

In FIG. 3*c*, the dividing element 31 is further pushed in direction to the second volume 33 by the vapour pressure of the liquefied gas with increased temperature. The balance between the pressure differences within the first volume 32 and the second volume 33 is guaranteed by the flexion property of the dividing element 31. The risk of over pressurization of the container 30 is maintained to a minimum, therefore the risk of bursting is limited.

Figure 4:
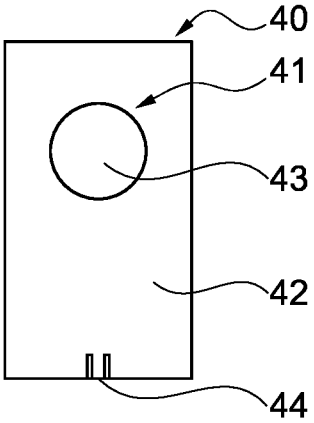
FIG. 4 is a schematic view of a container for a lighter according to an alternative aspect of the disclosure.

FIG. 4 presents an alternative aspect of the disclosure: a compressible element 41 is placed within a container 40 of a lighter, wherein the compressible element 41 is not connected to the side walls of the container, and has, for example, the shape of a ball. The element 41 divides the total volume of the container 40 in a first volume 42 configured to contain a liquefied gas or a mixture of a liquid and a gas, and a second volume 43 delimited by the external shape of the element 41. As for the previous aspects of the disclosure, the second volume 43 is subjected to pressure variations of the first volume 42 and can compress according to the expansion of the first volume 42. Element 41 may have the shape of a hollow ball, or may have the shape of a ball with multiple enclosed pores or cells.

Figures 5A, 5B, 5C:
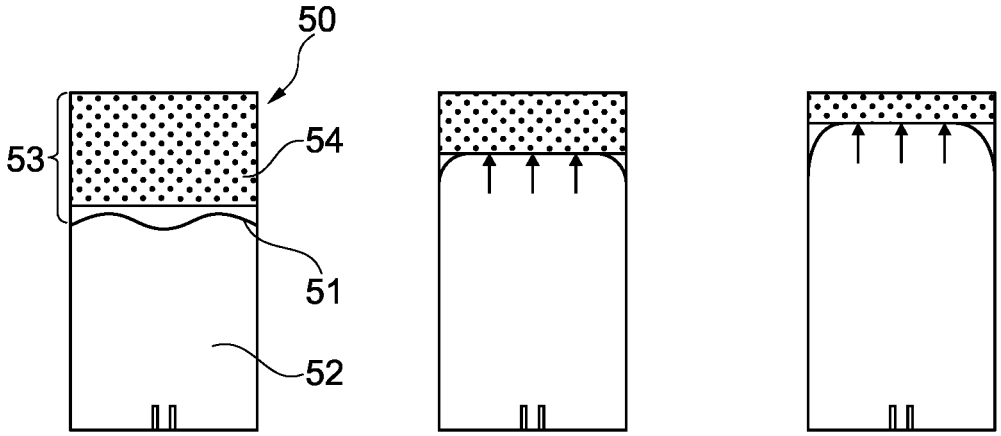
FIG. 5*a* to 5*c* are schematic views of a container of a lighter according to another aspect of the disclosure, in empty state (5*a*), filled state (5*b*) and pressurized state (5*c*).

FIGS. 5*a* to 5*c* present a container 50 according to a further aspect of the disclosure. Here, the total container volume is divided by a dividing element 51 such as a membrane or a flexible element into a variable first volume 52 and a variable second volume 53. The first volume 52 is configured to be filled with the liquefied gas and the second volume 53 comprises a compressible member 54. In FIG. 5*a*, the second volume is partially filled with the compressible member 54. Alternatively, the second volume may be fully filled with the compressible member. The dividing element 51 has the function to balance the pressure differences between the first volume 52 and the second volume 53. The addition of the first volume 52 and the second volume 53 is always constant and represents the total volume of the container 50. To not mix the content of the first volume 52 with the content of the second volume 53, the dividing element 51 defines a gas and fluid tight separation. In this embodiment, the dividing element 51 is fixed to the inner surface of the container 50. The location of the attachment points of the dividing element 51 to the inner surface of the container 50 is determined in combination with the material characteristics of the dividing element 51 such as to obtain an optimum volume repartition between the first volume 52 and the second volume 53, especially once the liquefied gas is filled within the first volume 52. Alternatively, the second volume defined by the dividing element and comprising the compressible member may not be connected to the side walls of the container and may have, for example, the shape of a ball (or any other closed shape).

This embodiment presents a combination of the previously disclosed first and second embodiments, comprising simultaneously a dividing element 51 and a compressible member 54. FIG. 5*a* shows the container 50 in an empty state. The first volume 52 does not contain any liquified gas nor any mixture of liquid and gas. The dividing element 51 and the compressible member 54 are subjected to ambient temperature and pressure. In FIG. 5*b*, the first volume 52 is filled with liquefied gas (or a mixture of liquid and gas). The dividing element 51 contacts the compressible member 54 as a result of the pressure of filling exerted by the first volume 52 on the dividing element 51. In FIG. 5*c*, the dividing element 51 is further pushed in direction to the second volume 53 (and compressible member 54) by the vapour pressure of the liquefied gas with increased temperature. The balance between the pressure differences within the first volume 52 and the second volume 53 is guaranteed by the flexion property of the dividing element 51 and the compression property of the compressible member 54. The risk of over pressurization of the container 50 is maintained to a minimum, therefore the risk of bursting is limited.

The volume proportions disclosed above also apply for the embodiment of FIGS. 5*a* to 5*c*. In the empty state (uncompressed state), the second volume 53 defined by the dividing element 51 and/or the compressible member 54 may occupy at least 10% of the total volume of the container 50, or at least 20%, or at least 30%. In the filled state (first compressed state), the liquefied gas exerts a pressure on the dividing element 51 of, for example, 250 kPa higher than the ambient pressure at 23° C., which leads the dividing element 51 to bend in direction of the second volume 53, i.e. the compressible member 54, and the compressible member to be compressed (by the pressure exerted by the first volume on the dividing element and/or the compressible member via the dividing element). Pressure is thus applied on both sides of the dividing element 51, which brings it to an equilibrium position within the container 50. Ideally, at this state, the second volume 53 occupies approximately 15% of the total volume of the container 50 to assure enough volume for the liquefied gas to expand. Alternatively, the second volume can occupy not more than 20% of the total volume of the container, or not more than 15%, or not more than 10%. Finally, in the pressurized state (second compressed state), the pressure exerted on the compressible member 54 further increases and can for example reach 1700 kPa above the ambient pressure or more, which leads the second volume 53 to reduce even more; the compressible member 54 occupies not more than 10% of the total volume of the container 50, or not more than 8%, or not more than 5%.

Any other characteristic disclosed for the previous embodiments may apply to the embodiment of FIGS. 5*a* to 5*c*.

Although the present disclosure has been described above and is defined in the attached claims, it should be understood that the disclosure may alternatively be defined in accordance with the following embodiments:

1. A lighter comprising a container which is preferably arranged within the lighter and which is suitable for containing a liquefied gas or a mixture of a liquid and a gas,
   characterized by a compressible member which is arranged in the container.
2. The lighter according to embodiment 1, wherein the compressible member divides the container volume into a first volume containing the liquefied gas or the mixture of liquid and gas and into a second separate volume, wherein the second volume corresponds to the volume of the compressible member.
3. The lighter according to embodiment 2, wherein the total container volume comprising the first volume and the second volume is constant at a given ambient pressure and a given ambient temperature.
4. The lighter according to embodiment 1 or 2, wherein the second volume can be reduced by expanding the first volume.
5. The lighter according to one of the preceding embodiments, wherein the compression state of the compressible member depends on the amount of the liquefied gas or the mixture of liquid and gas contained in the first volume.
6. The lighter according to one of the preceding embodiments, wherein the compressible member is compressed from an uncompressed state in which the pressure in the container is identical to the ambient pressure, to a first compressed state when the container is filled with a pre-set maximum amount of liquefied gas or of the mixture of liquid and gas.
7. The lighter according to embodiment 6, wherein the first compressed state of the compressible member is achieved when the container is filled with an amount of liquefied gas or of the mixture of liquid and gas at a pressure of 250 kPa above the ambient pressure.
8. The lighter according to embodiment 6 or 7, wherein the compressible member can be further compressed from the first compressed state to at least a second compressed state when the pressure in the container is increased by an expansion of the liquefied gas or the mixture of liquid and gas caused in particular by an increased temperature, in particular 60° or 90° C., compared to the temperature, in particular 23° C., which was present during the initial filling of the container with the pre-set maximum amount of liquefied gas or of the mixture of liquid and gas.
9. The lighter according to one of the preceding embodiments, wherein the compressible member occupies at least 10% of the total volume of the container when the pressure in the container is identical to the ambient pressure surrounding the lighter, in particular at least 20%, more particular at least 30%.
10. The lighter according to one of the preceding embodiments, wherein the compressible member occupies not more than 20% of the total volume of the container when the pressure in the container is 250 kPa higher than the ambient pressure surrounding the lighter, in particular not more than 15%, more particular not more than 10%.
11. The lighter according to one of the preceding embodiments, wherein the compressible member occupies not more than 10% of the total volume of the container when the pressure in the container is 1700 kPa higher than the ambient pressure surrounding the lighter, in particular not more than 8%, more particular not more than 5%.
12. The lighter according to one of the preceding embodiments, wherein the compressible member is made of a polymer, in particular polyurethane or butadiene-acrylonitrile copolymer.
13. The lighter according to one of the preceding embodiments, wherein the material of the compressible member is porous and comprises closed cells.
14. A lighter comprising a container which is preferably arranged within the lighter and which is suitable for containing a liquefied gas or a mixture of a liquid and a gas,
    characterized by a dividing element dividing the container volume in fluid-tight and gas-tight manner into a first volume containing the liquefied gas or the mixture of liquid and gas and into a second separate volume.
15. The lighter according to embodiment 14, wherein pressure differences between the first volume and the second volume are balanced within the container by deformation of the dividing element.
16. The lighter according to embodiment 15, wherein the dividing element is a membrane or a flexible element.
17. The lighter according to embodiment 15 or 16, wherein the total container volume comprising the first volume and the second volume is constant at a given ambient pressure and a given ambient temperature.

18. The lighter according to one of embodiments 15 to 17, wherein the second separate volume can be reduced by expanding the first volume.

19. The lighter according to one of embodiments 15 to 18, wherein the compression state of the second separate volume depends on the amount of the liquefied gas or the mixture of liquid and gas contained in the first volume.

20. The lighter according to one of embodiments 15 to 19, wherein the second separate volume is compressed from an uncompressed state in which the pressure in the container is identical to the ambient pressure, to a first compressed state when the container is filled with a pre-set maximum amount of liquefied gas or of the mixture of liquid and gas.

21. The lighter according to embodiment 20, wherein the first compressed state of the second separate volume is achieved when the container is filled with an amount of liquefied gas or of the mixture of liquid and gas at a pressure of 250 kPa above the ambient pressure.

22. The lighter according to embodiment 20 or 21, wherein the second separate volume can be further compressed from the first compressed state to at least a second compressed state when the pressure in the container is increased by an expansion of the liquefied gas or the mixture of liquid and gas caused in particular by an increased temperature, in particular 60° or 90° C., compared to the temperature, in particular 23° C., which was present during the initial filling of the container with the pre-set maximum amount of liquefied gas or of the mixture of liquid and gas.

23. The lighter according to one of embodiments 15 to 22, wherein the second separate volume occupies at least 10% of the total volume of the container when the pressure in the container is identical to the ambient pressure surrounding the lighter, in particular at least 20%, more particular at least 30%.

24. The lighter according to one of embodiments 15 to 23, wherein the second separate volume occupies not more than 20% of the total volume of the container when the pressure in the container is 250 kPa higher than the ambient pressure surrounding the lighter, in particular not more than 15%, more particular not more than 10%.

25. The lighter according to one of embodiments 15 to 24, wherein the second separate volume occupies not more than 10% of the total volume of the container when the pressure in the container is 1700 kPa higher than the ambient pressure surrounding the lighter, in particular not more than 8%, more particular not more than 5%.

26. The lighter according to one of the preceding embodiments, further comprising a compressible member arranged in the second separate volume 27. The lighter according to one of the preceding embodiments, wherein the liquefied gas of the mixture of liquid and gas has a vapour pressure at 23° C. that is equal or greater than 104 kPa.

28. The lighter according to one of the preceding embodiments, wherein the total container volume is in the range of 2 to 200 cm3, in particular in the range of 3 to 100 cm3, more particular in the range of 3 to 20 cm3.

29. The lighter according to one of the preceding embodiments, wherein the container can be refilled with liquefied gas or a mixture of liquid and gas.

30. The lighter according to one of the preceding embodiments, comprising a first valve device for refilling the container.

31. The lighter according to one of the preceding embodiments, further comprising a second valve device for withdrawing gas from the container.

32. The lighter according to one of the preceding embodiments, further comprising an igniting device for igniting the gas exiting the container through the second valve.

33. A container suitable for containing a liquefied gas or a mixture of a liquid and a gas, characterized by a compressible member which is arranged in the container or by a dividing element dividing the container volume into a first volume containing the liquefied gas or the mixture of liquid and gas and into a second separate volume.

The invention claimed is:

1. A lighter comprising a container which is arranged within the lighter and which is suitable for containing a liquefied gas or a mixture of a liquid and a gas, the container having a first volume and a second volume, and a first compressible member disposed within the second volume, wherein the first compressible member at least partially fills the second volume, wherein the first compressible member occupies not more than 15% of a total volume of the container when, in a first compressed state, the container is filled with a pre-set maximum amount of liquefied gas or of mixture of liquid and gas, and wherein the total volume of the container comprises the first volume and the second volume.

2. The lighter according to claim 1, wherein the total container volume comprising the first volume and the second volume is constant at a given ambient pressure and a given ambient temperature, wherein the second volume can be reduced by expanding the first volume.

3. The lighter according to claim 1, wherein the first compressible member is compressed from an uncompressed state in which the pressure in the container is identical to the ambient pressure, to the first compressed state.

4. The lighter according to claim 3, wherein the first compressed state of the first compressible member is achieved when the container is filled with an amount of liquefied gas or of the mixture of liquid and gas at a pressure of 250 kPa above the ambient pressure.

5. The lighter according to claim 3, wherein the first compressible member can be further compressed from the first compressed state to at least a second compressed state when the pressure in the container is increased by an expansion of the liquefied gas or the mixture of liquid and gas caused by an increased temperature compared to the temperature which was present during the initial filling of the container with the pre-set maximum amount of liquefied gas or of the mixture of liquid and gas.

6. The lighter according to claim 1, wherein the first compressible member occupies at least 15% of the total volume of the container when the pressure in the container is identical to the ambient pressure surrounding the lighter.

7. The lighter according to claim 1, wherein the first compressible member occupies at least 30% of the total volume of the container when the pressure in the container is identical to the ambient pressure surrounding the lighter.

8. The lighter according to claim 1, wherein the first compressible member occupies not more than 10% of the total volume of the container when the pressure in the container is 1700 kPa higher than the ambient pressure surrounding the lighter.

9. The lighter according to claim 1, wherein the first compressible member occupies not more than 20% of the total volume of the container when the pressure in the container is 250 kPa higher than the ambient pressure surrounding the lighter.

10. The lighter according to claim 1, wherein the first compressible member occupies not more than 10% of the total volume of the container when the pressure in the container is 250 kPa higher than the ambient pressure surrounding the lighter.

11. The lighter according to claim 1, wherein the first compressible member is made of a polymer.

12. The lighter according to claim 1, wherein a material of the first compressible member is porous and comprises closed cells.

13. The lighter according to claim 1, wherein the container can be refilled with liquefied gas or a mixture of liquid and gas, the lighter comprising:

a first valve device for refilling the container, a second valve device for withdrawing gas from the container, and an igniting device for igniting the gas exiting the container through the second valve, wherein the total volume is in the range of 2 to 200 $cm^3$.

14. The lighter according to claim 1, wherein the first compressible member occupies at least more than 50% of the second volume.

15. The lighter according to claim 1, further comprising a second compressible member, wherein the second compressible member divides the first volume containing the liquefied gas or the mixture of liquid and gas and the second volume.

16. The lighter according to claim 15, wherein the second compressible member is a membrane or a flexible element.

17. The lighter according to claim 1, wherein the first compressible member is a ball.

18. A lighter comprising a container which is arranged within the lighter and which is suitable for containing a liquefied gas or a mixture of a liquid and a gas, a dividing element dividing the container in fluid-tight and gas-tight manner into a first volume containing the liquefied gas or the mixture of liquid and gas and into a second volume, and a compressible member disposed within the second volume, wherein the compressible member at least partially fills the second volume, wherein the pressure differences between the first volume and the second volume are balanced within the container by deformation of the dividing element.

19. The lighter according to claim 18, wherein the dividing element is a membrane or a flexible element, wherein a total container volume comprising the first volume and the second volume is constant at a given ambient pressure and a given ambient temperature, and wherein the second volume can be reduced by expanding the first volume.

20. The lighter according to claim 18, wherein the compression state of the second volume depends on the amount of the liquefied gas or the mixture of liquid and gas contained in the first volume, wherein the second volume is compressed from an uncompressed state in which the pressure in the container is identical to the ambient pressure, to a first compressed state when the container is filled with a pre-set maximum amount of liquefied gas or of the mixture of liquid and gas.

* * * * *